US005853089A

United States Patent [19]

Milne

[11] Patent Number: 5,853,089

[45] Date of Patent: Dec. 29, 1998

[54] APPARATUS FOR DETECTING MULTIPLE SUPERPOSED SHEETS

[75] Inventor: Douglas L. Milne, Dundee, Scotland

[73] Assignee: NCR Corporation, Dayton, Ohio

[21] Appl. No.: 650,395

[22] Filed: May 20, 1996

[30] Foreign Application Priority Data

Dec. 16, 1995 [GB] United Kingdom ..... 9525767

[51] Int. Cl.[6] ..... B07C 5/08; B65H 7/12

[52] U.S. Cl. ..... 209/534; 209/604; 209/900; 271/263; 271/265.04; 250/559.27

[58] Field of Search ..... 209/534, 600, 209/601, 602, 603, 604, 900; 271/262, 258.01, 263, 265.01, 265.04; 250/559.19, 559.27

[56] References Cited

U.S. PATENT DOCUMENTS

| | | | |
|---|---|---|---|
| 4,154,437 | 5/1979 | Butcheck et al. | 271/263 X |
| 4,579,334 | 4/1986 | Durajczyk et al. | 209/604 X |
| 5,384,468 | 1/1995 | Milne et al. | 271/263 X |

FOREIGN PATENT DOCUMENTS

| | | | |
|---|---|---|---|
| 0344938 | 6/1989 | European Pat. Off. . | |
| 0344938 | 12/1989 | European Pat. Off. . | |
| 0344967 | 12/1989 | European Pat. Off. . | |
| 0596606 | 5/1994 | European Pat. Off. . | |
| 3200364 | 7/1982 | Germany . | |
| 5270698 | 10/1993 | Japan | 271/263 |
| 5301657 | 11/1993 | Japan | 271/263 |

OTHER PUBLICATIONS

Patent Abstracts of Japan, vol. 17, No. 527, (M–1484), 22 Sep. 1993 and JP 05 139572 A (OKI Electric Ind. Co. Ltd.), 8 Jun. 1993.

Patent Abstracts of Japan, vol. 95, No. 4, 31 May 1995, and JP 07 027555 A (Juki Corp.), 27 Jan. 1995.

*Primary Examiner*—Tuan N. Nguyen

[57] ABSTRACT

An apparatus for detecting the passage of superposed sheets, e.g. deposited currency notes, along a feed path includes a mechanism which has a pair of cooperating rollers (42,44) and which is arranged to generate an output voltage whose magnitude varies in response to the passage of an item (single or multiple sheet) between the rollers (42,44). Samples of this output voltage are taken during one complete revolution of one of the rollers (42,44). These samples are processed to generate a value representative of the cross-sectional area of said item. In order to take account of sheets of different sizes, a further value is generated representative of the dimension of said item parallel to its direction of feed. The value representing said cross-sectional area is divided by this further value in order to derive a value which represents the average thickness of said item and which enables a determination to be made as to whether said item is a single or multiple sheet.

18 Claims, 5 Drawing Sheets

APPARATUS FOR DETECTING MULTIPLE SUPERPOSED SHEETS

BACKGROUND OF THE INVENTION

This invention relates to an apparatus for detecting the passage of multiple superposed sheets along a feed path. The invention has application, for example, to an apparatus for detecting the passage of superposed currency notes in an automated teller machine (ATM).

In a cash dispensing mechanism of an ATM, it is important to provide a simple and reliable means for detecting when a currency note has become superposed on another in a path of travel from a currency supply means to a note exit slot, since such superpositioning may produce an undesirable result such as the dispensing of an excessive amount of money. For convenience, two or more sheets or notes which have become disposed in a superposed relationship will hereinafter be referred to as a multiple sheet or a multiple note.

From EP-B-0344938 there is known an apparatus for detecting multiple sheets in accordance with the preamble of claim 1. This apparatus includes first and second cooperating rollers between which sheets pass as they are fed along a feed path, the first roller having a fixed axis of rotation, and the second roller being resiliently urged towards the first roller so as to enable it to be moved away from the first roller as a single or multiple sheet passes between the rollers. A voltage generating means associated with the second roller produces an output voltage which varies linearly with movement of the second roller towards or away from the first roller, and this output voltage is applied to an analog-to-digital (A/D) converter. A data processor is connected to the output of the A/D converter and is arranged to perform the steps of: sampling the value of said output voltage (as represented by the output of the A/D converter) a predetermined number of times for an integral number (which may be one) of complete revolutions of one of the rollers when no sheet is passing between the rollers; storing a first digital value representative of the sum of the values sampled in the last-mentioned step; sampling the value of said output voltage said predetermined number of times for an integral number of complete revolutions of said one of the rollers when an item comprising a single or multiple sheet is passing between the rollers; storing a second digital value representative of the sum of the values sampled in the last-mentioned step; and subtracting the first digital value from the second digital value to produce a third digital value on the basis of which a determination is made as to whether a single or multiple sheet has passed between the rollers.

As mentioned in the above-identified document, this known apparatus has a number of advantages one of which is that by virtue of summing the values of said output voltage while a single or multiple note is passing between the rollers (so as to produce said second digital value) it is possible to distinguish between a multiple note and a single note which is folded or creased. A further advantage of this apparatus is that by virtue of subtracting said first digital value (stored when no sheet is passing between the rollers) from said second digital value (so as to produce said third digital value) possible problems due to roller noise are eliminated. By roller noise is meant variations in the output of said voltage generator brought about by various factors such as bearing wear and tolerances, dirt on the rollers and roller eccentricity. It will be appreciated that said third digital value is representative of the cross-sectional area of the multiple or single sheet taken along that dimension of the sheet corresponding to the direction of feed.

A more particular application of the present invention is to a cash recycling ATM in operation of which currency notes deposited in the ATM by one user of the ATM may be dispensed by the ATM to another user. Deposited notes may be of different denominations which in general will have different sizes. It is necessary to separate deposited notes and to make various checks on them to determine their validity, denomination and condition. After deposited notes have been separated and before these checks are made, it is desirable to pass the notes through a multiple note detect mechanism. Since notes passing through a multiple note detect mechanism may be of significantly different sizes, it is not practical to use in such system the multiple note detect mechanism described in EP-B-0344938 in view of the fact that the relevant cross-sectional areas of a large size note and of two superposed notes of smaller size may be very similar.

SUMMARY OF THE INVENTION

It is an object of the invention to provide an apparatus for detecting multiple sheets which retains the advantages of the known apparatus referred to above and which may also be used in a system where sheets fed to the apparatus in a cycle of operation may be of different sizes.

According to the invention there provided an apparatus for detecting the passage of superposed sheets along a feed path, including first and second cooperating rollers, said first roller having a fixed axis of rotation, means for feeding sheets along said feed path between said rollers, means for mounting said second roller so that its axis is movable relative to that of said first roller and so that it is biased towards said first roller to enable said second roller to be displaced away from said first roller in response to a single or multiple sheet passing between said first and second rollers, voltage generating means associated with said second roller and arranged to produce an output voltage which varies linearly with movement of the axis of said second roller towards or away from the axis of said first roller, analog-to-digital converter means to which said output voltage is applied, pulse generating means for generating timing pulses in timed relationship with the revolution of said rollers, sensor means for sensing the presence of an item comprising a single or multiple sheet as it passes a point in said feed path, and data processing means connected to the outputs of said converter means, said pulse generating means and said sensor means, said data processing means being arranged to perform the following steps: (a) sampling the value of said output voltage, as represented by the output of said converter means, a predetermined number of times for one complete revolution, or for an integral number of complete revolutions, of one of said rollers when no sheet is passing between said rollers, (b) storing a first digital value representative of the sum of the values of said output voltage sampled in step (a), (c) sampling the value of said output voltage, as represented by the output of said converter means, said predetermined number of times for one complete revolution, or for an integral number of complete revolutions, of said one of said rollers when said item is passing between said rollers, (d) storing a second digital value representative of the sum of the values of said output voltage sampled in step (c), and (e) subtracting said first digital value from said second digital value to produce a third digital value, characterized in that said data processing means is arranged to perform the following additional steps: (f) counting the number of pulses generated by said pulse generating means while said sensor means is sensing the presence of said item and thereby generating a fourth digital value representative of the dimension of said item corresponding to its direction of feed along said feed path, (g) dividing said second digital value by said fourth digital value to provide a fifth digital value representative of the mean thickness of said item, and (h) making a determination as to whether or not to reject said item on the basis of said fourth digital value.

BRIEF DESCRIPTION OF THE DRAWINGS

One embodiment of the invention will now be described by way of example with reference to the accompanying drawings, in which.

DETAILED DESCRIPTION

Figure 1:
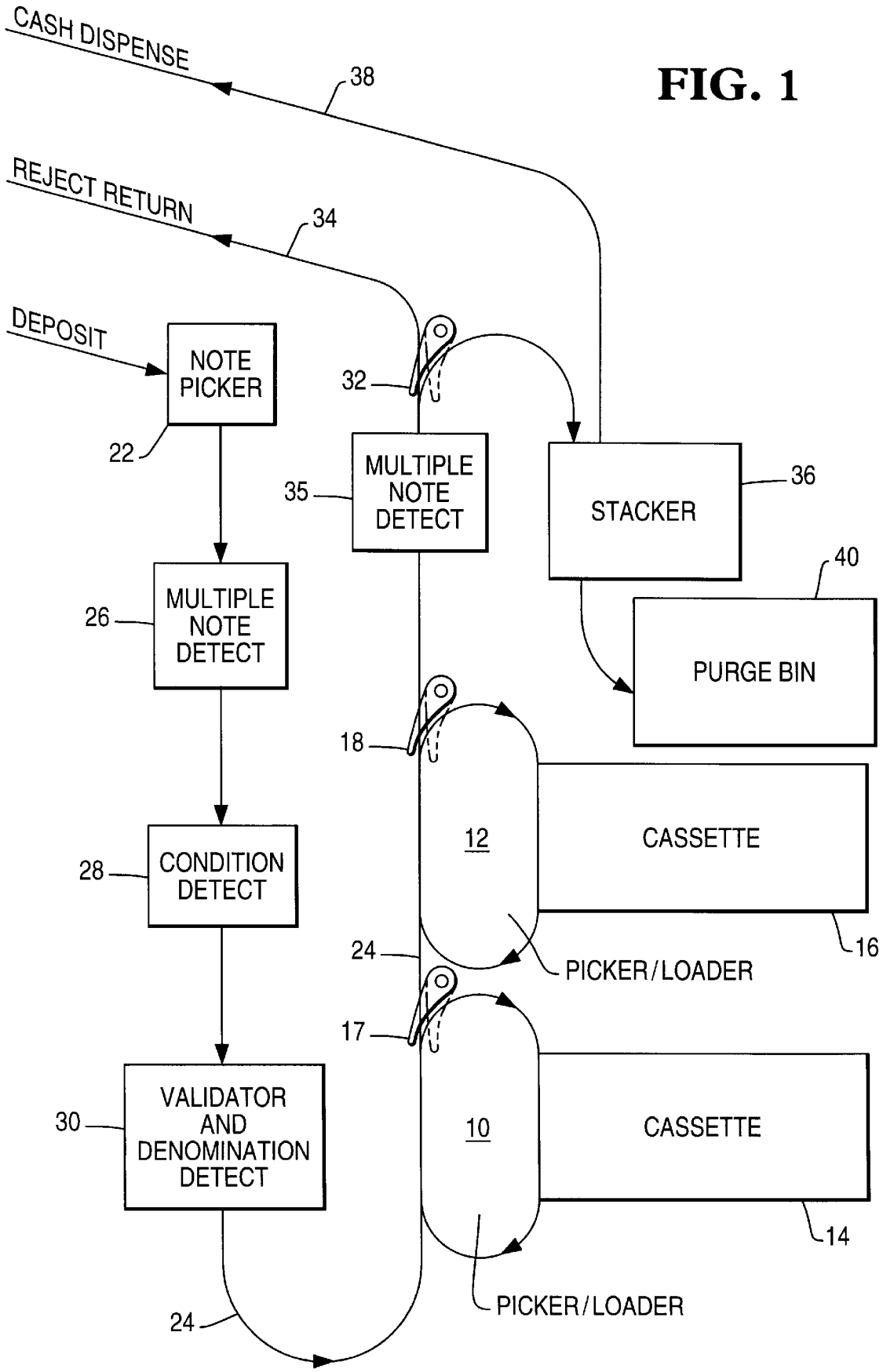
FIG. 1 is a schematic block diagram of a cash recycling ATM which has two currency note picker/loader mechanisms for currency notes of first and second denominations and which has a multiple note detect apparatus in accordance with the invention.
Figure 5:
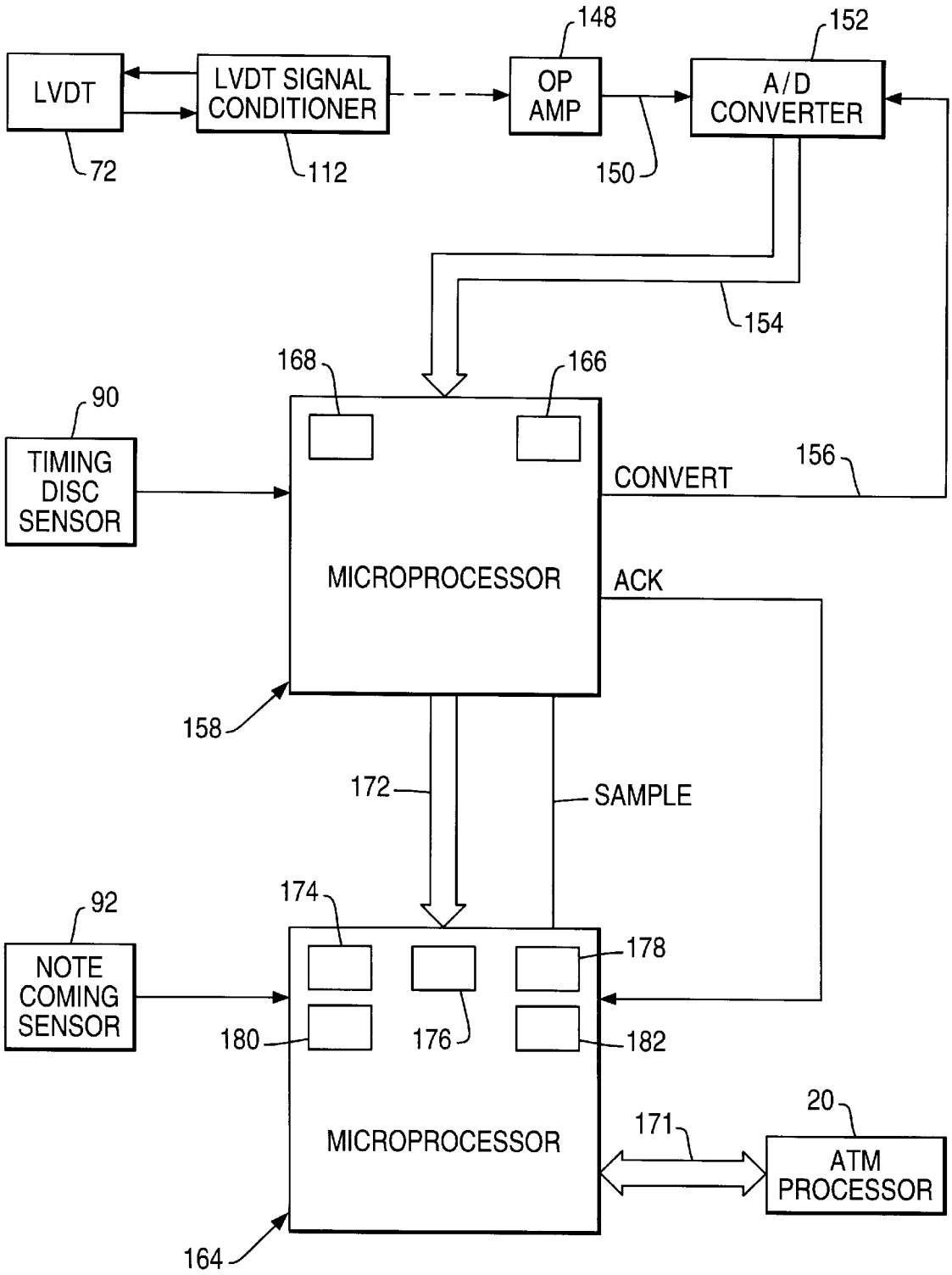
FIG. 5 is a block circuit diagram of the multiple note detect apparatus.

Referring to FIG. 1 of the drawings, the cash recycling ATM shown therein includes two picker/loader mechanisms 10 and 12 respectively associated with two currency cassettes 14 and 16. The picker/loader mechanisms 10 and 12 are of known construction, and may be similar to the mechanisms described in EP-A-0582473. The cassette 14 is arranged to have currency notes of a first denomination loaded into it and picked therefrom, and the cassette 16 is arranged to have currency notes of a second denomination, different from the first denomination, loaded into it and picked therefrom. Although the cash recycling ATM described herein accepts and dispenses notes of only two denominations, it should be understood that the ATM could be modified to accept and dispense notes of more than two different denominations, in which case more than two picker/loader mechanisms and associated cassettes would be incorporated in the ATM, depending on the number of different denominations of notes handled by the ATM. The picker/loader mechanisms 10 and 12 have two gates 17 and 18 respectively associated therewith. Each of the gates 17 and 18 is selectively movable between a loading position shown in solid outline in FIG. 1 and a picking position shown in chain outline in FIG. 1 under the control of the main ATM processor 20 (FIG. 5).

Using keyboard control means (not shown), a user of the ATM can request the ATM to accept a cash deposit or to dispense cash. In conventional manner, the user inserts a user identifying card into the ATM, and enters on the keyboard control means his personal identification number and the quantity of cash to be paid in or to be withdrawn. If a cash deposit mode of operation is requested, then the user deposits one or more currency notes of one or both of said first and second denominations into a note deposit slot (not shown) from where they are fed to note picker means 22. From the note picker means 22, deposited notes are fed in correct operation one by one along an entry feed path 24 via a multiple note detect apparatus 26 in accordance with the invention for detecting the passage of multiple superposed notes, via condition detect means 28 for determining whether each of the deposited notes is of acceptable condition, and via validator and denomination detect means 30 for determining whether each of the deposited notes is genuine and for determining the denomination of each genuine deposited note. If a deposited note is rejected by any of the above-mentioned means 26, 28 and 30, then the gates 17 and 18 are set to the picking position shown in chain outline in FIG. 1. Also, a further gate 32 is set to a reject position shown in chain outline in FIG. 1, the gate 32 being settable between the reject position and a stacking position shown in solid outline under the control of the ATM processor 20. The rejected single or multiple note is then fed along a rejected note feed path 34 and returned to the user at a rejected note exit (not shown). If a deposited note is accepted after having passed through the multiple note detect means 26, the condition detect means 28 and the validator and denomination detect means 30, then the accepted note is loaded into the appropriate one of the cassettes 14 and 16 by the associated picker/loader mechanism 10 and 12, the associated gate 17 or 18 having previously been set to its loading position.

If a cash withdrawal mode of operation is requested, then the gates 17 and 18 are set to the picking positions shown in chain outline and the gate 32 is set to the note stacking position shown in solid outline. In accordance with the cash withdrawal request, an appropriate number of currency notes are picked in conventional manner from one or both of the cassettes 14 and 16 by the associated picker/loader mechanism(s) 10 and/or 12. The picked notes are fed via a conventional multiple note detect means 35 to conventional stacker means 36 where the notes are formed into a stack. Finally, the stack of notes is fed along an output feed path 38 to an exit slot (not shown) for collection by the user. If the multiple note detect means 35 detects the passage of multiple superposed notes, then, instead of being fed to the user, the stack of notes is fed from the stacker means 36 into a purge bin 40.

Figure 2:
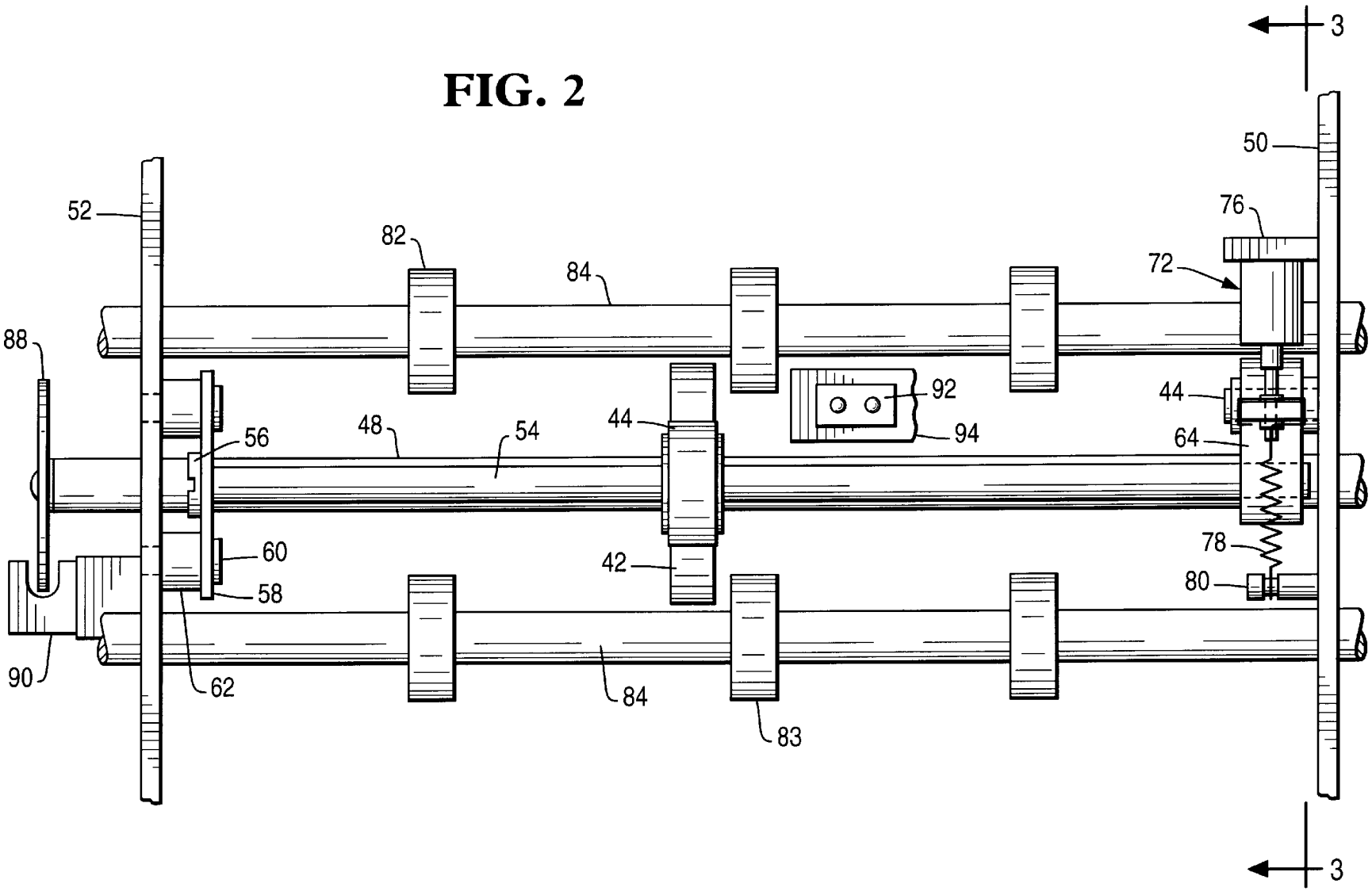
FIG. 2 is a front elevational view of a note sensing mechanism of the multiple note detect apparatus of FIG.1.
Figure 3:
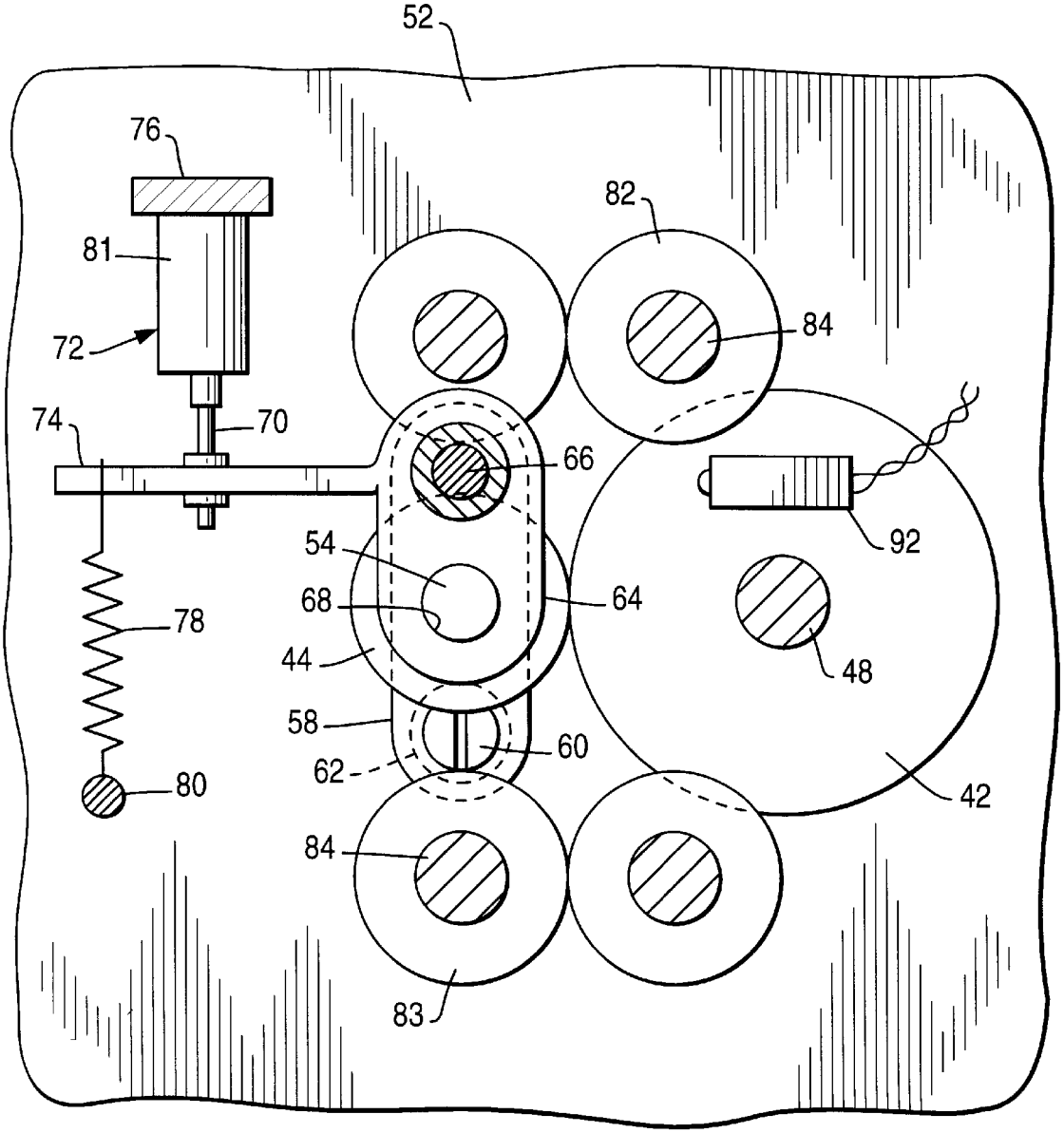
FIG. 3 is a part sectional side elevational view of the note sensing mechanism of FIG. 2 taken along the line 3—3 of FIG. 2.

Referring now to FIGS. 2 and 3, the multiple note detect apparatus 26 in accordance with the invention includes a steel roller 42 having a fixed axis of rotation and a cooperating steel roller 44 having a movable axis of rotation, the diameter of the roller 42 being exactly twice that of the roller 44. As will be explained later, the roller 44 is resiliently urged into engagement with the roller 42, and currency notes (not shown) are fed in operation between the rollers 42 and 44, with the short dimension of each note extending parallel to the direction of feed.

The roller 42 is secured on a drive shaft 48 which extends between, and is rotatably mounted with respect to, a pair of side frame members 50 and 52, and the roller 44 is rotatably mounted on a rigid rod 54 which, in the absence of any currency note between the rollers 42 and 44, extends parallel to the drive shaft 48. The roller 44 is caused to rotate in operation by virtue of its resilient engagement with the roller 42 or with a note passing between the rollers 42 and 44. The left hand end (with reference to FIG. 2) of the rod 54 is secured by means of a screw 56 to a narrow plate 58 of plastics material which is disposed generally parallel to the side frame member 52. The ends of the plate 58 are secured to the member 52 by means of bolts 60, the plate 58 being spaced from the inner surface of the member 52 by spacer members 62.

A connector member 64 is pivotally mounted on a stud 66 secured to the inner surface of the side frame member 50. That end of the rod 54 remote from the plate 58 is supported by the connector member 64, this end passing through, and being a tight fit with respect to, a circular aperture 68 formed in the connector member 64 below the stud 66. The connector member 64 is connected to a vertically extending armature 70 of a linear variable differential transformer (LVDT) 72 by means of an arm 74 which is formed integral with the connector member 64 and which extends therefrom in a generally horizontal direction. The LVDT 72 is mounted on a bracket 76 secured to the side frame member 50, and the free end of the arm 74 is connected by means of a spring 78 to a stud 80 secured to the member 50, the spring 78 serving to urge the assembly of the connector member 64 and the 74 in an anticlockwise direction (with reference to FIG. 3) about the stud 66. The plate 58 has a certain amount of inherent flexibility, and by virtue of this flexibility the rod 54 is pivotable to some extent about a point substantially at the center of the plate 58. Normally, the roller 44 is urged into engagement with the roller 42 under the action of the spring 78. Upon one or more currency notes passing between the rollers 42 and 44, pivotal movement of the rod 54 is brought about in a direction such that the right hand end (with reference to FIG. 2) of the rod 54 is moved away from the drive shaft 48. This pivotal movement of the rod 54 brings about pivotal movement of the connector member 64 in a clockwise direction (with reference to FIG. 3) about the stud 66 against the action of the spring 78, and in turn this movement of the connector member 64 brings about an upward movement of the armature 70 of the LVDT 72 by means of the arm 74. Upon the currency note or notes leaving the nip of the rollers 42 and 44, the spring 78 returns the rod 54 to its home position, with the roller 44 in engagement with the roller 42, and also moves the armature 70 in a downward direction back to its home position via the arm 74. It should be understood that the nature of the guidance of the armature 70 within the housing 81 of the LVDT 72 permits the angular movement of the arm 74 to be translated into up and down movement of the armature 70 over the small extent of pivotal movement of the rod 54 encountered in operation.

Movement of currency notes in a downward direction between the rollers 42 and 44 is brought about by means of pairs of cooperating rubber feed rolls 82 and 83 mounted on shafts 84, the shafts 84 extending between, and being rotatably mounted with respect to, the side frame members 50 and 52. The feed rolls 82 and 83 and the drive shaft 48 for the roller 42 are driven via transmission means (not shown) by an electric motor (not shown). As shown in FIGS. 2 and 3, the feed rolls 82 are positioned above the rollers 42 and 44, and the feed rolls 83 are positioned beneath the rollers 42 and 44.

A timing disc 88 is secured to the end of the drive shaft 48 projecting beyond the side frame member 52, the disc 88 carrying a series of 90 radially extending black regions (not seen) equally spaced around the axis of the shaft 48, each successive pair of black regions being separated by a clear region having the same angular width as each black region. The disc 88 cooperates with an optical sensor 90 mounted on the side frame member 52, and in operation the sensor 90 generates a series of timing pulses in response to the sensing of the marks carried by the disc 88. The sensor 90 generates a timing pulse for each transition which it senses between black and clear regions on the timing disc 88, and so a series of 180 equally spaced timing pulses are generated by the sensor 90 for each complete revolution of the roller 42. A further optical sensor 92, arranged to sense the approach of a currency note to the nip of the rollers 42 and 44, is mounted on a bracket 94 secured to the side frame member 50.

Figure 4:
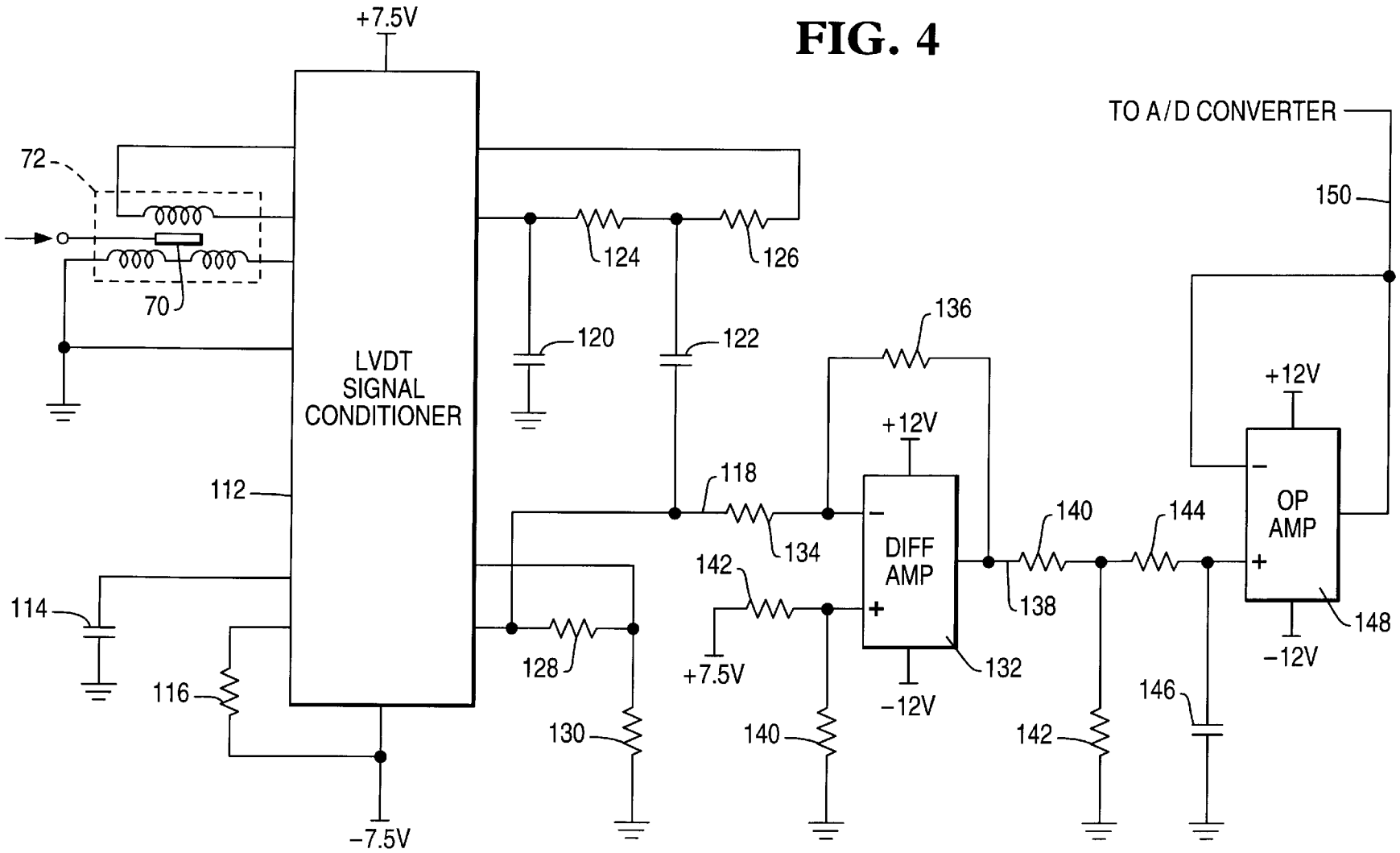
FIG. 4 is a circuit diagram of means for generating an output voltage which varies in accordance with the thickness of a sensed note.

Referring now to FIG. 4, the LVDT 72 is connected to a conventional LVDT signal conditioner 112. As is known, the signal conditioner 112 is in the form of an integrated circuit incorporating a low distortion, amplitude stable sine wave oscillator with programmable frequency for driving the primary winding of the LVDT 72, a synchronous demodulator for converting the LVDT output amplitude and phase to position information, and an output amplifier for providing amplification and filtering of the demodulated signal. A capacitor 114 and a resistor 116 set the modulation frequency of the primary winding of the LVDT 72 AT 14 KHz. The output of the signal conditioner 112 appears on an output line 118, the demodulator output of the signal conditioner 112 being connected to the output line 118 via a low pass filter comprising capacitors 120 and 122 and resistors 124 and 126 connected as shown in FIG. 4, and the gain of the output of the signal conditioner 112 being set by resistors 128 and 130. In the embodiment described, the output voltage appearing on the line 118 changes from +5 volts to −5 volts as the armature 70 moves into the LVDT 72 from its lowermost position to its uppermost position.

The output line 118 of the signal conditioner 112 is connected to the negative terminal of a differential amplifier 132 via a resistor 134, this terminal being connected via a resistor 136 to the output line 138 of the amplifier 132. The positive terminal of the amplifier 132 is connected to ground via a resistor 140 and is connected to a +7.5 volts supply via a resistor 142. The differential amplifier 132 serves to change the +5 volts to −5 volts output of the signal conditioner 112 into a 0 to +10 volts swing on the line 138. The line 138 is connected via a voltage divider comprising resistors 140 and 142 and an RC filter comprising a resistor 144 and a capacitor 146 to the positive terminal of an operational amplifier 148, the negative terminal of which is connected to the output line 150 of the amplifier 148. The voltage divider 140, 142 serves to limit the output swing of the amplifier 132 to a 0 to +5 volts swing, and the combination of RC filter 144, 146 and the operational amplifier 148 serves as a low pass filter to remove the effect of the low frequency mechanical oscillations of the LVDT armature 70 brought about by the return spring 78 (FIGS. 2 and 3). Thus, it will be appreciated that the signal appearing on the line 150 is a DC voltage between zero and +5 volts which varies linearly with movement of the armature 70 into and out of the LVDT 72 and which therefore also varies linearly with angular movement of the axis of the roller 44 towards and away from the axis of the roller 42 (FIGS. 2 and 3).

Referring now also to FIG. 5, the output line 150 is connected to a first input of an analog-to-digital (A/D) converter 152 which serves to convert the voltage appearing on the line 150 to an 8 bit digital word the bits of which appear on the output lines 154 of the A/D converter 152. A control line 156 is connected to the A/D converter 152, and the operation of the converter 152 is controlled by a low level control pulse CONVERT applied to the line 156. An analog-to-digital conversion takes place in response to the appearance of the pulse CONVERT on the line 156, this pulse having a duration of approximately 50 $\mu$s. The output lines 154 are connected to a microprocessor 158 which is arranged to process the information appearing on the lines 154 in a manner to be described later.

The output of the timing disc sensor 90 is connected to the microprocessor 158. As previously mentioned, the sensor 90 generates a series of 180 timing pulses for each complete revolution of the roller 42. In operation, the microprocessor 158 receives low level signals SAMPLE over a line 162 from a further microprocessor 164. Prior to receiving a signal SAMPLE, the microprocessor 158 has stored the number 180 (i.e. the number of timing pulses generated for one revolution of the roller 42) in an internal memory location 166, and the contents of a further internal memory location 168 have been set to zero. In response to receipt of a signal SAMPLE, the microprocessor 158 sends a low level pulse ACK to the microprocessor 164 by way of acknowledgment. Following receipt by the microprocessor 158 of the signal SAMPLE, each timing pulse applied to the microprocessor 158 decrements the contents of the memory location 166 by one and causes a control pulse CONVERT to be applied to the A/D converter 152 over the line 156. The application of each pulse CONVERT to the A/D converter 152 causes the A/D converter 152 to apply to the microprocessor 158 an 8 bit digital number representing the value of the voltage appearing on the line 150 at the instant the pulse CONVERT is applied to the A/D converter 152, this number being added to the number (which initially is zero) contained in the memory location 168. When the contents of the memory location 166 have been reduced to zero, the application of further control pulses CONVERT to the A/D converter 152 is inhibited, and at this time the memory location 168 contains a 16 bit number representing the sum of 180 samples of the output of the A/D converter 152, that is to say the sum of 180 samples of the value of the voltage appearing on the line 150 in the course of one complete revolution of the roller 42.

The operation of the multiple note detect apparatus 26 as part of a cash deposit transaction will now be described. This operation is controlled by the microprocessors 158 and 164, the microprocessor 164 being connected via a bus 171 to the main ATM processor 20. When the main ATM processor 20 advises the microprocessor 164 that a cash deposit transaction is to take place, the microprocessor 164 applies a signal SAMPLE to the microprocessor 158 prior to any deposited currency note reaching the nip of the rollers 42 and 44. It will be appreciated that, in response to this signal SAMPLE, the microprocessor 158 will cause to be stored in the memory location 168 a 16 bit number representing the sum of 180 samples of the value of the voltage on the line 150 in the course of one complete revolution of the roller 42 when no currency note is passing between the rollers 42 and 44. An 8 bit digital number representing the 8 most significant bits (most significant byte) of the number stored in the memory location 168 is then applied to the microprocessor 164 over a communications bus 172 and stored in an internal memory location 174 of the microprocessor 164. At this stage the contents of the memory location 168 are reset to zero, and the number 180 is stored in the memory location 166. It should be understood that the number stored in the memory location 174 is a number representing the average value of the voltage appearing on the line 150 in the course of one complete revolution of the roller 42, when no currency note 16 is passing between the rollers 42 and 44.

Immediately prior to a single or multiple currency note entering the nip of the rollers 42 and 44, the microprocessor 164 applies another signal SAMPLE to the microprocessor 158. Upon receipt of this signal SAMPLE, the microprocessor 158 will cause to be stored in the memory location 168 a 16 bit number representing the sum of 180 samples of the value of the voltage on the line 150 for one complete revolution of the roller 42 in the course of which the single or multiple note passes between the rollers 42 and 44, said voltage being of increased value for the period for which the single or multiple note is present between the rollers 42 and 44. An 8 bit digital number representing the 8 most significant bits of the number stored in the memory location 168 is then applied to the microprocessor 164 over the bus 172 and stored in an internal memory location 176 of the microprocessor 164. It should be understood that the number stored in the memory location 176 is a number representing the average value of the voltage appearing on the line 150 for one complete revolution of the roller 42 when the last-mentioned single or multiple note passes between the rollers 42 and 44. Next, the microprocessor 164 subtracts the number stored in the memory location 174 from the number stored in the memory location 176 and stores the remainder in a further internal memory location 178 of the microprocessor 164.

It should be understood that as the two rollers 42 and 44 rotate with no currency note passing between them, the voltage output of the signal conditioner 112, and thus the voltage appearing on the line 150, will vary slightly due to roller noise, as previously mentioned. The diameter of the fixed axis roller 42 is exactly twice that of the roller 44, so that during one complete revolution of the roller 42 there will be exactly two revolutions of the smaller roller 44. Thus, all the roller noise will be generated in one revolution of the fixed axis roller 42, and this noise will be substantially repetitive from one revolution to the next. The number stored in the memory location 174 is a reference value representative of the roller noise. Since the voltage on the line 150 varies linearly with movement of the axis of the roller 44 towards or away from the axis of the roller 42, by subtracting the reference value stored in the memory location 174 from the number stored in the reference location 176, there is obtained a value (the number stored in the memory location 178) proportional to the cross-sectional area of the single or multiple note which passed between the rollers 42 and 44 when the number stored in the memory location 176 was generated, the roller noise having no effect on this last-mentioned value.

In addition to being applied to the microprocessor 158, the output of the timing disc sensor 90 is also applied to the microprocessor 164. The output of the note coming sensor 92 is applied to the microprocessor 164, and the microprocessor 164 counts the number of pulses generated by the timing disc generator 90 during the period of time for which the sensor 92 is sensing the passage past it of a single or multiple note. It will be appreciated that the number of timing pulses counted by the microprocessor 164 during this period is representative of that dimension of the single or multiple note parallel to the direction of feed, which is the short dimension of a single note. If this number is in excess of a predetermined number this means that two or more overlapping notes have been sensed by the sensor 92, and in this situation the microprocessor 164 generates a single REJECT which is effective to reject the overlapping notes and to return them to the user along the rejected note feed path 34 (FIG. 1), the gates 17, 18 and 32 having been set to the positions shown in chain outline in FIG. 1.

It should be understood that the just-mentioned predetermined number is less than the number of timing pulses generated for one complete revolution of the roller 42. Assuming that the number of timing pulses counted by the microprocessor 164 while the sensor 92 is sensing the passage of a single note is not greater than said predetermined number, then the microprocessor 164 divides the number stored in the memory location 178 by the number of timing pulses counted and stores the quotient in a further memory location 180 in the microprocessor 164. Since as previously explained the number stored in the memory location 178 is proportional to the cross-sectional area of the single or multiple note which has just passed between the rollers 42 and 44, then the number stored in the memory location 180 is representative of the average thickness of this single or multiple note.

All notes handled by the cash recycling ATM have the same nominal thickness, regardless of the denomination of the notes, and a number representing this nominal thickness is stored in a memory location 184 of the microprocessor 164. The microprocessor 164 compares the number stored in the memory location 182 with the number stored in the memory location 184 and as a result makes an accurate determination as to whether the item which has just passed between the rollers 42 and 44 is a single or multiple note, this determination being unaffected by the denomination of the note or notes. If a determination is made that the item in question is a multiple note then, as previously described, the multiple note is rejected and is returned to the user along the reject return path 34. If a determination is made that the item in question is a single note then, unless it is rejected for some other reason, the note is loaded into an appropriate one of the cassettes 14 and 16 in accordance with the denomination of the note as determined by the validator and denomination detect mechanism 30.

In alternative embodiments of the present invention, the numbers stored in the memory locations 174 and 176 could be numbers representing the average value of the voltage appearing on the line 150 for a period of time corresponding to more than one complete revolution of the roller 42; also, it is not essential that the diameter of the roller 42 is twice that of the roller 44.

In the present embodiment the roller 42 has a circumference of 180 millimeters. Since 180 timing pulses are generated for one complete revolution of the roller 42, it will be appreciated that, when a single or multiple note is passing between the rollers 42 and 44, samples of the values of the voltage appearing on the line 150 are taken at intervals of 1 millimeter across the width of the note. In general, it is preferable that such samples should be taken at intervals of 2 millimeters or less across the width of the note.

The multiple note detect apparatus 26 described above has the advantage that roller noise is compensated automatically by the utilization of the reference value generated at the beginning of each cash deposit transaction. This arrangement also allows the rollers 42 and 44 and the related bearings to be manufactured to a lower tolerance, thereby providing a reduction in manufacturing costs. Also, since the apparatus 26 makes a determination of the average thickness of a single or multiple note passing through it, it will operate reliably even though notes of different denominations (and therefore of different sizes) are fed to it.

A further advantage of the multiple note detect apparatus 26 is that its operation is not affected by possible variation in the speed of the motor which drives the roller 42 and the timing disc 88. Thus, the timing disc sensor 90 generates a pulse for every 2 degrees of rotation of the roller 42 and the timing disc 88, irrespective of the speed at which the roller 42 and the disc 88 are rotating.

What is claimed is:

1. An apparatus for detecting the passage of superposed sheets along a feed path, said apparatus comprising:

first and second cooperating rollers, said first roller having a fixed axis of rotation;

means for feeding sheets along said feed path between said rollers;

means for mounting said second roller so that its axis is movable relative to that of said first roller and so that it is biased towards said first roller to enable said second roller to be displaced away from said first roller in response to a single or multiple sheet passing between said first and second rollers;

voltage generating means associated with said second roller and arranged to produce an output voltage which varies linearly with movement of the axis of said second roller towards or away from the axis of said first roller;

analog-to-digital converter means to which said output voltage is applied;

pulse generating means for generating timing pulses in timed relationship with the revolution of said rollers;

first sensor means for sensing the presence of an item comprising a single or multiple sheet as it passes a point in said feed path; and data processing means connected to the outputs of said converter means, said pulse generating means and said first sensor means, said data processing means being arranged to perform the following steps:

(a) sampling the value of said output voltage, as represented by the output of said converter means, a predetermined number of times for one complete revolution, or for an integral number of complete revolutions, of one of said rollers when no sheet is passing between said rollers;

(b) storing a first digital value representative of the sum of the values of said output voltage sampled in step (a);

(c) sampling the value of said output voltage, as represented by the output of said converter means, said predetermined number of times for one complete revolution, or for an integral number of complete revolutions, of said one of said rollers when said item is passing between said rollers;

(d) storing a second digital value representative of the sum of the values of said output voltage sampled in step (c);

(e) subtracting said first digital value from said second digital value to produce a third digital value;

(f) counting the number of pulses generated by said pulse generating means while said first sensor means is sensing the presence of said item and thereby generating a fourth digital value representative of the dimension of said item corresponding to its direction of feed along said feed path;

(g) dividing said third digital value by said fourth digital value to provide a fifth digital value representative of the mean thickness of said item; and (h) making a determination as to whether or not to reject said item on the basis of said fifth digital value.

2. An apparatus according to claim 1, wherein said data processing means is arranged to bring about a rejection of said item in the event that the count made in step (f) exceeds a predetermined number.

3. An apparatus according to claim 2, wherein the diameter of said one of said rollers is equal to, or a multiple of, the diameter of said other roller.

4. An apparatus according to claim 2, wherein said predetermined number is less than the number of pulses generated by said pulse generating means for one complete revolution of said one of said rollers.

5. An apparatus according to claim 4, wherein said pulse generating means includes a rotatable timing member which is arranged to rotate in synchronism with said one of said rollers and which is in cooperative relationship with second sensor means which is arranged to generate said pulses in response to rotation of said timing member.

6. An apparatus according to claim 1, wherein each of steps (a) and (c) said data processing means is arranged to sample the value of said output voltage in response to each pulse received from said pulse generating means during the relevant step.

7. An apparatus according to claim 1, wherein step (c), during the passage of said item between said rollers, said data processing means is arranged to sample the value of said output voltage at intervals of not more than 2 millimeters along said dimension.

8. An apparatus for detecting the passage of superposed sheets along a feed path, said apparatus comprising:

first and second cooperating rollers, said first roller having a fixed axis of rotation;

a feeder unit for feeding sheets along said feed path between said rollers;

a support structure for mounting said second roller so that its axis is movable relative to that of said first roller and so that it is biased towards said first roller to enable said second roller to be displaced away from said first roller in response to a single or multiple sheet passing between said first and second rollers;

a voltage generating unit associated with said second roller and arranged to produce an output voltage which varies linearly with movement of the axis of said second roller towards or away from the axis of said first roller;

an analog-to-digital converter unit to which said output voltage is applied;

a pulse generating unit for generating timing pulses in timed relationship with the revolution of said rollers;

a first sensor unit for sensing the presence of an item comprising a single or multiple sheet as it passes a point in said feed path; and a data processing unit connected to the outputs of said converter unit, said pulse generating unit and said first sensor unit, said data processing unit being arranged to perform the following steps:

(a) sampling the value of said output voltage, as represented by the output of said converter unit, a predetermined number of times for one complete revolution, or for an integral number of complete revolutions, of one of said rollers when no sheet is passing between said rollers;

(b) storing a first digital value representative of the sum of the values of said output voltage sampled in step (a);

(c) sampling the value of said output voltage, as represented by the output of said converter unit, said predetermined number of times for one complete revolution, or for an integral number of complete revolutions, of said one of said rollers when said item is passing between said rollers;

(d) storing a second digital value representative of the sum of the values of said output voltage sampled in step (c);

(e) subtracting said first digital value from said second digital value to produce a third digital value;

(f) counting the number of pulses generated by said pulse generating unit while said first sensor unit is sensing the presence of said item and thereby generating a fourth digital value representative of the dimension of said item corresponding to its direction of feed along said feed path;

(g) dividing said third digital value by said fourth digital value to provide a fifth digital value representative of the mean thickness of said item; and (h) making a determination as to whether or not to reject said item on the basis of said fifth digital value.

9. An apparatus according to claim 8, wherein said data processing unit is arranged to bring about a rejection of said item in the event that the count made in step (f) exceeds a predetermined number.

10. An apparatus according to claim 9, wherein the diameter of said one of said rollers is equal to, or a multiple of, the diameter of said other roller.

11. An apparatus according to claim 9, wherein said predetermined number is less than the number of pulses generated by said pulse generating unit for one complete revolution of said one of said rollers.

12. An apparatus according to claim 11, wherein said pulse generating unit includes a rotatable timing member which is arranged to rotate in synchronism with said one of said rollers and which is in cooperative relationship with a second sensor unit which is arranged to generate said pulses in response to rotation of said timing member.

13. An apparatus according to claim 8, wherein each of steps (a) and (c) said data processing unit is arranged to sample the value of said output voltage in response to each pulse received from said pulse generating unit during the relevant step.

14. An apparatus according to claim 8, wherein step (c), during the passage of said item between said rollers, said data processing unit is arranged to sample the value of said output voltage at intervals of not more than 2 millimeters along said dimension.

15. A method of detecting the passage of superposed sheets along a feed path between a first roller and a second roller which is movable away from the first roller in response to an item comprising a single or multiple sheet passing between the first and second rollers, the method comprising the steps of:

(a) sampling the value of an output voltage a predetermined number of times for one complete revolution or for an integral number of complete revolutions of one of the rollers when no sheet is passing between the rollers;

(b) storing a first digital value representative of the sum of the values of the output voltage sampled in step (a);

(c) sampling the value of the output voltage the predetermined number of times for one complete revolution or for an integral number of complete revolutions of the one of the rollers when the item is passing between the rollers;

(d) storing a second digital value representative of the sum of the values of the output voltage sampled in step (c);

(e) subtracting the first digital value from the second digital value to produce a third digital value;

(f) counting the number of pulses generated by a pulse generating unit while a sensor unit is sensing the presence of the item and thereby generating a fourth digital value representative of the dimension of the item corresponding to its direction of feed along the feed path;

(g) dividing the third digital value by the fourth digital value to provide a fifth digital value representative of the mean thickness of the item; and (h) making a determination as to whether or not to reject the item on the basis of the fifth digital value.

16. A method according to claim 15, further comprising the step of:

(i) rejecting the item in the event that the count made in step (f) exceeds a predetermined number.

17. A method according to claim 15, wherein step (a) includes the step of:

(a-1) sampling the value of the output voltage in response to each pulse received from the pulse generating unit.

18. A method according to claim 17, wherein step (c) includes the step of:

(c-1) sampling the value of the output voltage in response to each pulse received from the pulse generating unit.

* * * * *